US009475685B2

(12) United States Patent
Davenport et al.

(10) Patent No.: US 9,475,685 B2
(45) Date of Patent: Oct. 25, 2016

(54) DYNAMIC GRAPHICAL DISPLAY FOR A BEVERAGE DISPENSING SYSTEM

(71) Applicant: Starbucks Corporation, Seattle, WA (US)

(72) Inventors: Kellie Sue Davenport, Seattle, WA (US); Anthony Lee Perez, Mercer Island, WA (US); James Edward Snook, Redmond, WA (US); Timothy Darragh, Seattle, WA (US); Gauthier Pompougnac, Vancouver (CA); Tyrone Samson, Seattle, WA (US)

(73) Assignee: STARBUCKS CORPORATION, Seattle, WA (US)

( * ) Notice: Subject to any disclaimer, the term of this patent is extended or adjusted under 35 U.S.C. 154(b) by 150 days.

(21) Appl. No.: 13/791,587

(22) Filed: Mar. 8, 2013

(65) Prior Publication Data

US 2013/0245819 A1 Sep. 19, 2013

Related U.S. Application Data

(60) Provisional application No. 61/612,098, filed on Mar. 16, 2012.

(51) Int. Cl.

| | |
|---|---|
| ***B67D 7/74*** | (2010.01) |
| ***B67D 1/08*** | (2006.01) |
| ***G07F 13/02*** | (2006.01) |

(52) U.S. Cl.

CPC ..... *B67D 1/0872* (2013.01); *G07F 13/02* (2013.01)

(58) Field of Classification Search

CPC ..... B67D 1/0872; B67D 1/0877
USPC ..... 222/129.1, 129.4; 715/771
See application file for complete search history.

(56) References Cited

U.S. PATENT DOCUMENTS 3,934,759 A * 1/1976 Giannella et al. ..... 222/129.1
5,244,119 A 9/1993 Pittman (Continued)

FOREIGN PATENT DOCUMENTS

DE 10 2007 027125 A1 10/2008
EP 1992263 A1 11/2008

(Continued)

OTHER PUBLICATIONS

International Search Report and Written Opinion mailed Aug. 12, 2013 in connection with PCT Application No. PCT/US2013/029716.

(Continued)

*Primary Examiner* — Patrick M Buechner
(74) *Attorney, Agent, or Firm* — Knobbe Martens Olson & Bear, LLP

(57) ABSTRACT

Systems and methods are provided for generating a dynamic graphical display for use in a product dispensing system, wherein the content of the display is dynamically generated based, at least in part, by the dispensing of a product. The product dispensing system can be a beverage dispensing system. When an operator activates a product dispenser to dispense a product, product imagery and/or related information may be dynamically generated and presented on a graphical display. A product dispensing and display system can include multiple product dispensers (for example, beverage taps) and an associated display for displaying dynamic digital content (such as visual and/or audible content) based on information received from the product dispensers and/or other input sources.

19 Claims, 10 Drawing Sheets

(56) References Cited

U.S. PATENT DOCUMENTS

| | | | | |
|---|---|---|---|---|
| 6,759,072 | B1 | 7/2004 | Gutwein et al. | |
| 8,245,739 | B1 * | 8/2012 | Wade et al. | 141/94 |
| 2007/0215239 | A1 | 9/2007 | Dorney | |
| 2007/0241120 | A1 | 10/2007 | Henry | |
| 2011/0192495 | A1 * | 8/2011 | Deo et al. | 141/95 |
| 2011/0315711 | A1 * | 12/2011 | Hecht et al. | 222/129.1 |
| 2012/0287021 | A1 * | 11/2012 | Park | G02F 1/13336 345/1.3 |

FOREIGN PATENT DOCUMENTS

| | | | |
|---|---|---|---|
| EP | 2 381 428 | A1 | 10/2011 |
| JP | 5358742 | B1 | 12/2013 |
| JP | 5534268 | B1 | 6/2014 |
| WO | WO 2004/030438 | A2 | 4/2004 |
| WO | WO 2007/003062 | A1 | 1/2007 |
| WO | WO 2007/003990 | A2 | 1/2007 |
| WO | WO 2011/067157 | A1 | 6/2011 |

OTHER PUBLICATIONS

Starbucks Corporation. (2015). Black coffee of Starbucks Pike place® roast Debuts [Press release, Aug. 4, 2015]. Retrieved from http://www.starbucks.co.jp/press_release/pr2015-1367.php.

Suntory foods international co., Ltd. (2015). Launches Starbucks black coffee Pike place® roast [Press release, Aug. 4, 2015]. Retrieved from http://suntory.co.jp/softdrink/news/pr/d/sbf0338.html.

Wikipedia entry for Video wall—Jan. 16, 2012 revision, available at https://en.wikipedia.org/w/index.php?title=Video_wall&oldid=471684739, retrieved on Jan. 8, 2016.

* cited by examiner

DYNAMIC GRAPHICAL DISPLAY FOR A BEVERAGE DISPENSING SYSTEM

RELATED APPLICATIONS

This application claims the benefit of, and priority to, U.S. Provisional Application Ser. No. 61/612,098, filed on Mar. 16, 2012, entitled "Dynamic Graphical Display for a Beverage Dispensing System," which is incorporated herein by reference in its entirety.

BACKGROUND

Restaurants and cafés often provide in-store menu boards or displays that include textual identifiers and cost values of menu items. The menu boards generally include very limited information about the food or beverage items. Some menus also include static graphical images of food or beverage items. Customers view the menu board or display and order a desired food and/or beverage item based on the textual identifier and cost value of the item, which may include additions or modifications, such as side dishes, substitutions, flavors or mix-ins. The customers then wait while an employee prepares the food item.

In a self-serve context, various vending machines and other dispensing units include a graphical display that enable individual customers to order their own beverages and/or food items, e.g., via a touch screen user interface. For example, a customer via the touch screen user interface may order a beverage by selecting an icon associated with a desired base flavor and selecting one or more icons associated with respective additional flavors or ingredients.

BRIEF DESCRIPTION OF THE DRAWINGS

The features of embodiments of the inventions will become more readily appreciated as the same become better understood by reference to the following detailed description, when taken in conjunction with the accompanying drawings, wherein.

Figure 1:
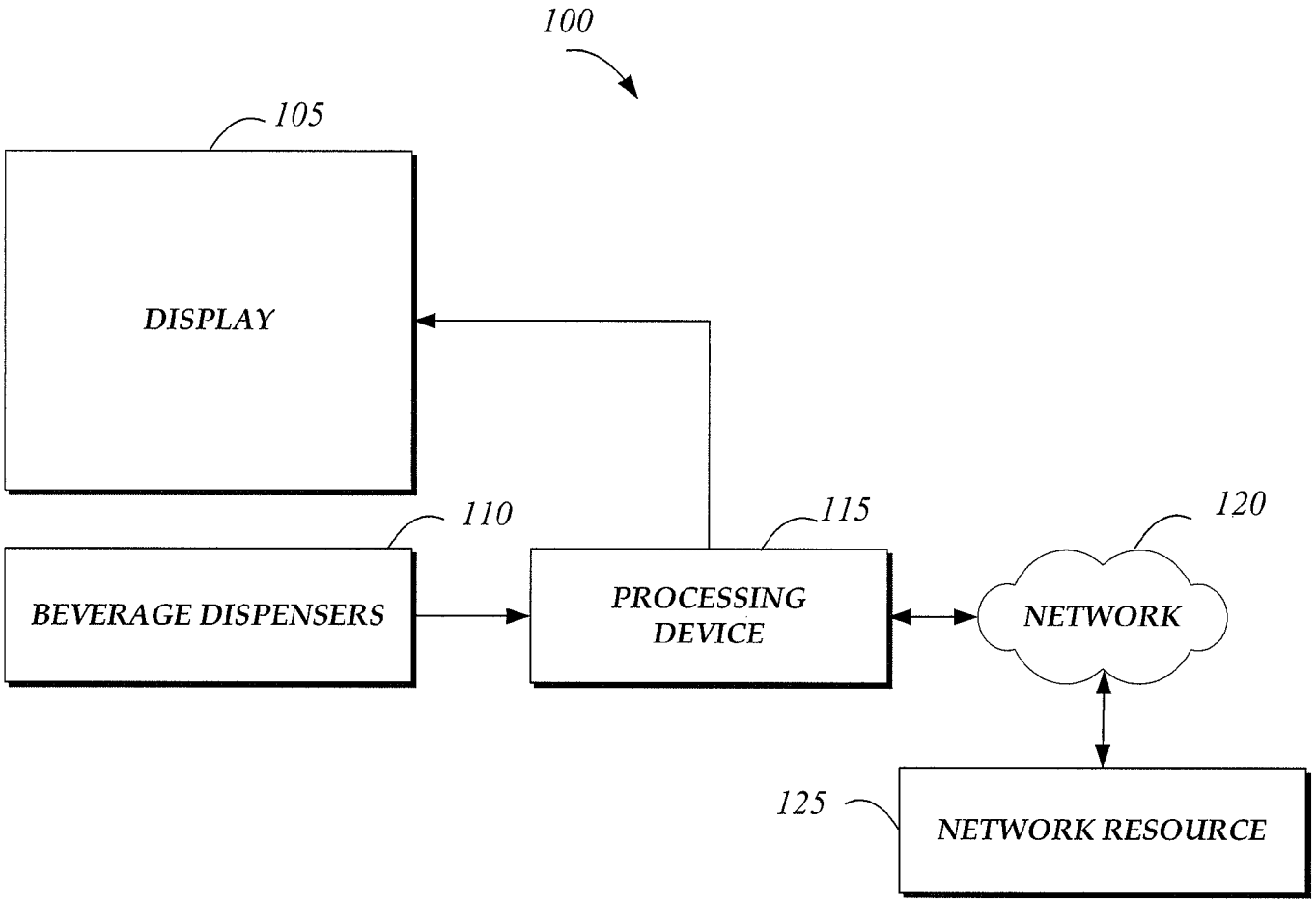
FIG. 1 is a schematic block diagram depicting an illustrative operating environment of a beverage dispensing and display system in which visual content is generated and dynamically presented on a display by a processing device based on information received from one or more beverage dispensers.

Throughout the drawings, reference numbers are re-used to indicate correspondence between referenced elements. The drawings are provided to illustrate embodiments of the inventions described herein and not to limit the scope thereof.

DETAILED DESCRIPTION

I. Introduction

Generally described, aspects of the present disclosure relate to a dynamic graphical display for use in product dispensing and display systems, wherein the content of the display is dynamically generated in response to the dispensing of one or more products (such as edible substances). The dispensing and display systems can include, for example, beverage dispensing systems, food dispensing systems, other product dispensing systems, or combinations of the same. When an operator activates a dispenser of a dispensing system, product imagery and/or related information may be dynamically generated and presented on a graphical display associated with the dispensing system. One illustrative example of a dispensing and display system in accordance with embodiments of the inventions described herein is a beverage dispensing and display system.

The dispensing and display system can include multiple dispensers (for example, beverage taps) and an associated display for displaying dynamic content that is generated based, at least in part, on information received from the dispensers and/or other input sources. In some embodiments, the dispensers and the associated display form an integrated unit. The dispensers may be located below the display (possibly mounted on a wall). The content presented on the display can originate from a position on the display that is adjacent to a dispenser that is in active operation, thereby proving an interactive "living" display experience. The content presented on the display can be correlated to a particular dispenser and, potentially, with a particular beverage ingredient being dispensed by the dispenser.

The dispensing and display systems described herein can be located in a coffeehouse, juice store, restaurant, retail store, parlor, food stall at a food court, or other public establishment or facility. The dynamic graphical display can foster an interactive experience that provides patrons with information and visually aesthetic visual content corresponding to particular beverages or to particular beverage ingredients being prepared based on requests by patrons of the public establishment. For example, the dynamic graphical display can present digital content corresponding to the beverage ingredient(s) being dispensed. The digital content can include, for example, visual content, audio content, or combinations of the same. The visual content can include, for example, visual representations of the beverage ingredients, graphical imagery (which may animate or evolve over time and blend or interact with other graphical imagery), and/or textual information regarding the beverage ingredients (such as nutritional benefits, historical information, advertising or branding information). The audible content can include, for example, music, tones, narrative, etc., which can also be presented in addition to, or in lieu of, the visual content without departing from the spirit and/or scope of the present disclosure. The display can include an audio display or output (e.g., one or more speakers) to present the audible content.

In some implementations, a patron can request a particular beverage (which may be previously identified as including one or more beverage ingredients), can request one or more beverage ingredients, or can specify one or more criteria, such as desired nutrients (for example, protein or vitamins), desired flavors, desired effects or benefits (such as energy boost, but low in fat) and/or the like. An operator can then prepare a beverage based on the patron's request or specifications. As the beverage is being prepared by an operator (such as a barista, juiceologist, or employee), visual content can be output on the display that is based, at least in part, on the particular beverage or beverage ingredients requested by the patron. In some implementations, the visual content can be based, at least in part, on an identification of a patron such that the visual content can be customized or tailored to the patron.

For example, each beverage dispenser can be associated with a particular beverage ingredient and particular visual content can be associated with each particular beverage ingredient. In some implementations, a label or identifier of the beverage ingredient associated with each beverage dispenser can be presented on the display at a location adjacent (e.g., slightly above) the beverage dispenser. The information received from the beverage dispensers may also include duration of time that a particular beverage ingredient is being dispensed. The visual content appearing on the display can be dynamically modified as different beverage dispensers are activated.

In some embodiments, the display can be implemented such that it is capable of transitioning between multiple display states (e.g., an idle state, a menu state, and an active state). The activation of one or more of the beverage dispensers can trigger the display to enter into an active state, wherein dynamic visual content is displayed corresponding to the beverage products being dispensed by the one or more beverage dispensers. As additional beverage dispensers are activated, the visual content can be dynamically modified even further to allow the visual content associated with each beverage ingredient being dispensed to overlap, blend and interact. The visual content associated with the active display state can be animated content that moves and evolves over time, thereby causing the display to function as a dynamic "living" display. The visual content can include a variety of images or video of various colors and textures, thereby advantageously providing a more aesthetically appealing experience.

In some implementations, the visual content presented on the display is dependent on one more factors (such as the number of beverage dispensers activated, the duration of activation of the beverage dispenser, the type of beverage ingredient (e.g., juice) being dispensed, etc. The visual content of the active state can resolve or cease after a period time following the completion of dispensing of beverage products by one or more beverage dispensers. When none of the beverage dispensers are dispensing beverage product and the visual content generated in the active state resolves to static images after the animations have completed, the display can be caused to enter into an idle display state, which can correspond to a default state or sleep state.

In the idle display state, informational content can be presented for display. The informational content can include, but is not limited to, content related to brand statements, process statements, health promotion program statements, nutrition statements, ingredient information (such as historical or fun facts), product information (such as hand-crafted or custom beverage products), educational information, or information generated based on use or status of the beverage dispensers (for example, the first beverage made that day or the first beverage ingredient used for the day, milestone information (such as "Pineapple [juice] was dispensed for the $100^{th}$ time")), weather information, calendar information (such as local event information), promotional information, advertising or branding information, information received from one or more social media websites (e.g., micro-posts or "tweets") and/or other types of information. The visual content can be pre-generated content or dynamically modifiable or adjustable content. In some implementations, the visual content is provided as a series of animations (for example, by executing video files such as .mov, .avi, .divx, or .mpeg files). The various animations can be displayed randomly or pseudo-randomly. For example, the animations can have parameters set to control frequency of display. In some implementations, the various animations can be displayed according to a pre-determined sequence. The content presented in the idle display state can include visual content, audible content, or combinations of the same.

A menu display state can be entered by activation of an operator input, such as a menu override button or toggle switch. The menu state can take precedence, or priority, over the active and idle display states, such that the current visual content presented on the display is interrupted and replaced with menu content. In the menu display state, a digital menu can be presented on the display. The digital menu can be static or dynamic and can include visual information (e.g., graphical representations of beverage ingredients) and/or alphanumeric information (e.g., textual identifiers or descriptions of beverage ingredients and pricing information). The digital menu can be presented on substantially the entire display or on a portion of the display. The content presented in the menu display state can include visual content, audible content, or combinations of the same. In other implementations, the menu display state may be activated according to a programmed input (e.g., on a time schedule or event-based instead of an operator input.

II. Beverage Dispensing and Display Environment Overview

FIG. 1 is a schematic block diagram depicting an illustrative operating environment of a beverage dispensing and display system 100 in which visual content is generated and dynamically presented on a display based on information received from one or more beverage dispensers. The beverage dispensing and display system 100 includes a display 105, multiple beverage dispensers 110, a processing device 115, a network 120 and a network resource 125, such as a web site In one embodiment, the display 105 and beverage dispensers 110 are mounted to a wall within a restaurant or other food/beverage serving establishment.

The display 105 can be designed to present digital content generated by the processing device 115. The digital content generated by the processing device 115 can be based, at least in part, on beverage dispensing information received from the plurality of beverage dispensers 110 as beverage products are being dispensed. The digital content can include visual content, audible content, or combinations of the same. The processing device 115 can use the beverage dispensing information to determine which of the beverage dispensers are currently dispensing beverage products, the beverage products being dispensed, and/or the amount of beverage product dispensed, among other things. In some implementations, the visual content is indicative or reflective of beverage products being dispensed by one or more of the beverage dispensers. The visual content can be generated such that the visual content originates in a region or position adjacent to the one or more beverage dispensers currently dispensing beverage products, thereby providing an indication to patrons of the beverage ingredients being added to a particular beverage.

The display 105 can be a wall-mounted graphical display, such as an array of multiple display monitors or a single display unit. In some embodiments, the display 105 is a portion of a wall on which a graphical display can be projected from a projector. In one embodiment, the beverage dispensers 110 each include a handle or tap for dispensing a beverage or beverage ingredient and at least one sensor mounted to or within the tap that, when activated, indicates that the particular beverage dispenser is actively dispensing beverage product and may also indicate for how long the beverage is dispensed. The processing device 115 can determine, for example, which beverage dispensers 110 are dispensing beverage product, how long the dispensers dispensed the beverage product, and how much beverage product is dispensed, from operational information provided by the sensors and then generate visual content based, at least in part, on an identification of the beverage dispensers actively dispensing beverage product.

The processing device 115 may be any computing device, such as a processing unit, laptop or tablet computer, personal computer, personal digital assistant (PDA), hybrid PDA/mobile phone, mobile phone, electronic book reader, set-top box, camera, digital media player, and the like. The processing device 115 may be implemented using a single computing device or multiple computing devices. Illustrative components and further details of the processing device 115 will be described below (for example, in connection with FIGS. 2 and 3).

Those skilled in the art will appreciate that the network 120 may be any wired network, wireless network or combination thereof. In addition, the network 120 may be a personal area network, local area network, wide area network, cable network, satellite network, cellular telephone network, or combination thereof. Protocols and components for communicating via the Internet or any of the other aforementioned types of communication networks are well known to those skilled in the art of computer communications and thus, need not be described in more detail herein.

The network resource 125 may be designed to support interaction with multiple electronic computing and/or communication devices over the network 120. The network resource 125 may be embodied in a plurality of components or hardware devices, each executing an instance of the network resource 125. A web server or other computing component implementing the network resource 125 may include a network interface, memory, processing unit, and computer readable medium drive, all of which may communicate with one another by way of a communication bus. The network interface may provide connectivity over the network 120 and/or other networks or computer systems. The processing unit may communicate to and from memory containing program instructions that the processing unit executes in order to operate the network resource 125. The memory generally includes RAM, ROM, and/or other persistent and auxiliary computer readable media. The network resource 125 may receive from and/or transmit to the processing device 115 messages related to the beverage dispensing and display system 100. In some implementations, the messages may have been or can be displayed on the display 105.

Figure 2:
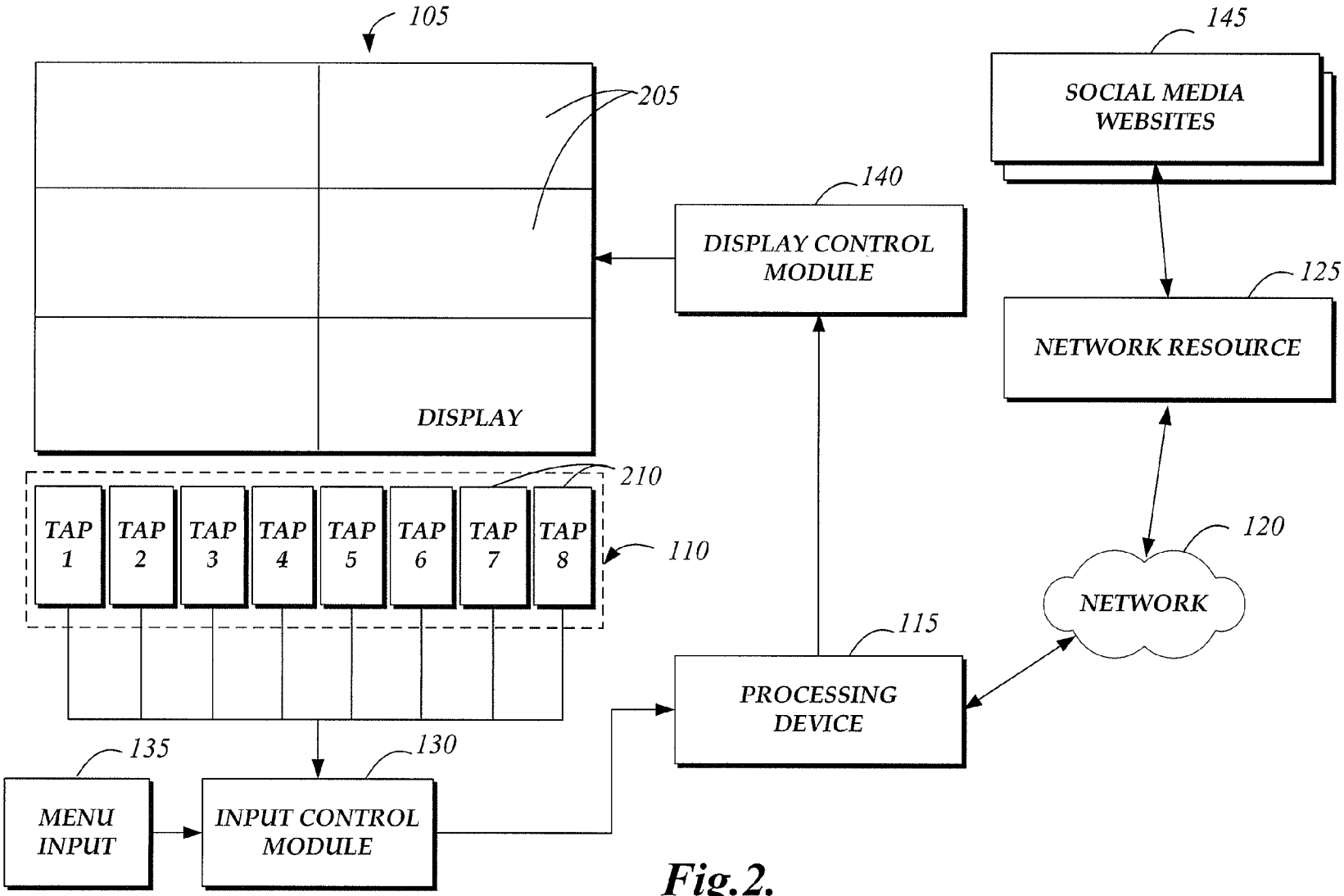
FIG. 2 is a schematic block diagram depicting illustrative components of the beverage dispensing and display system of FIG. 1.

With reference to FIG. 2, illustrative components of the beverage dispensing and display system 100 of FIG. 1 are described in more detail. The processing device 115 can receive multiple inputs and output dynamic visual content to the display 105 based, at least in part, on the multiple inputs.

As shown in FIG. 2, the display 105 can be an array of display monitors (e.g., 2×3, 3×2, 3×3, 3×4, 4×4) forming a display or video unit or multi-display array. The display monitors 205 may be mounted to a wall or wall unit with any variety of support structures. The display monitors 205 may be liquid crystal display (LCD) monitors, light emitting diode (LED) monitors, 3D monitors, plasma screens, television monitors, computer monitors, rear projection screens, other types of display screens or monitors, or a combination thereof. In some implementations, the display 105 is a single display screen or monitor. The display 105 may also include one or more audio output devices (e.g., speakers) to output audible content (e.g., sounds, voice narrations, etc.) received from the processing device 115.

With reference to FIG. 2, the beverage dispensers 110 can include beverage taps 210 including a spout, a pull handle, and one or more sensors designed to be actuated by movement of the pull handle, such that when the pull handle is activated to dispense beverage product, a sensor is activated; and when the pull handle is released, the sensor is deactivated (or vice-versa). An illustrative beverage tap having a sensor is described in more detail below with reference to FIG. 7. The sensor may be a push-button sensor, a switch, a flow sensor, or a proximity sensor, for example. The sensor may be capable of toggling between an on (e.g., active) state and an off (e.g., inactive) state. In the illustrative embodiment shown in FIG. 2, eight beverage taps 210 are included, with four beverage taps being positioned to the right of a vertical center line of the display and four beverage taps being positioned to the left of the vertical center line of the display. Other quantities of beverage taps 210 can be used as desired (e.g., two, three, four, five, six, seven, eight, nine, ten, eleven, twelve, or more).

The beverage dispensing and display system 100 can further include an input control module 130 that receives input signals from the beverage tap sensors and transmits information related to operation of the beverage taps 210 to the processing device 115. The input control module 130 may also receive input signals from a menu override input 135. The menu override input 135 can generate input signals that cause the processing device 115 to cause the display to enter a menu display state in which any existing display content is replaced with menu content (such as a digital menu). In some implementations, the menu display state takes precedence over any other display state.

The menu override input 135 may be implemented as one, two or more physical user input devices, each capable of providing an input signal to the input control module 130 (e.g., for sake of convenience or redundancy). For example, the menu override input 135 can include a first user input device positioned on (e.g., mounted to) one side of the display (e.g., the left side) and a second user input device positioned on (e.g., mounted to) the other side of the display (e.g., the right side). The menu override input 135 may be any type of user input device, such as a push-button, a switch, a touchscreen input, and/or the like. The user input device may be any toggle input device capable of having an on state (e.g., active state) and an off state (e.g., inactive state). The menu content can be displayed across the entire area of the display 105 or across at least a substantial portion of the area of display 105. In some implementations, the menu content can be presented for display on a small portion of the display 105 such that additional content can also be presented for display. For example, different menu inputs can control the presentation of menu content on various portions of the display 105.

The input control module 130 may communicate with the processing device 115 by transmitting information according to any suitable communications interface, standard or protocol, such as the Universal Serial Bus (USB) standard. The communications interface between the input control module 130 and the processing device 115 may be provided wirelessly (e.g., wireless USB) or via a wired connection.

The input control module 130 may be implemented using an application-specific integrated circuit (ASIC) or a microcontroller, such as an Arduino single-board microcontroller (e.g., an Arduino MEGA 2560 microcontroller). Input signals from the beverage tap sensors may be received by the input control module 130 over one or more communication cables or over one or more wireless communications interfaces. For example, in one implementation, the input signals from the beverage tap sensors may be received by the input control module 130 over CAT-5 Ethernet cables. In some implementations, there is no input control module 130 and the signals from the beverage tap sensors are transmitted directly to a serial-in I/O port of the processing device 115, such that the beverage tap sensors act as keyboard-like inputs.

Figure 3:
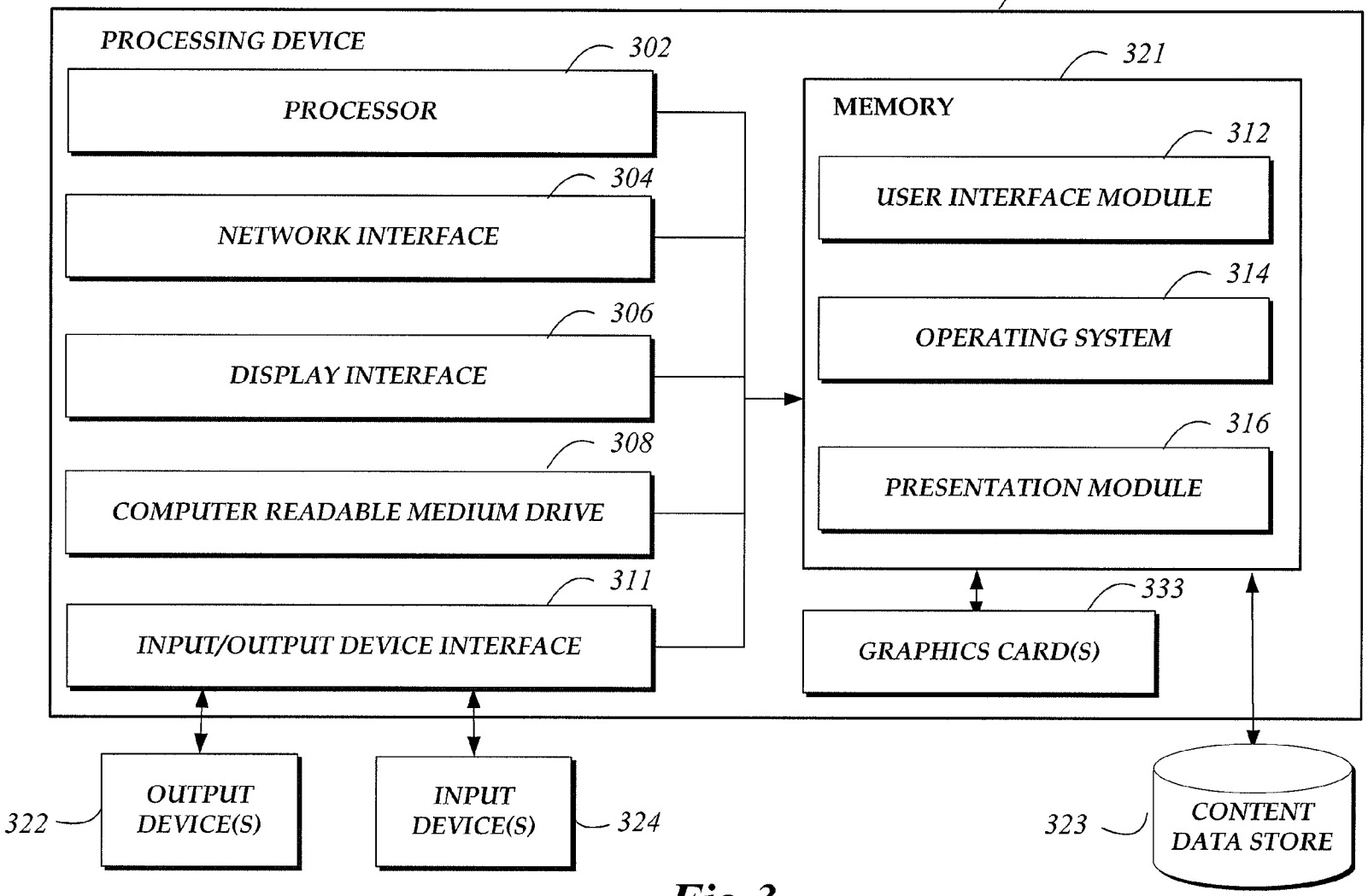
FIG. 3 depicts a general architecture of the processing device of FIGS. 1 and 2 for presenting dynamic visual content on the display of the beverage dispensing and display system based on information received from multiple inputs.

With reference to FIG. 3, a general architecture of the processing device 115 for receiving multiple inputs and generating and outputting visual content for a dynamic graphical display is provided. The processing device 115 may have one or more processors 302 in communication with a network interface 304, a display interface 306, a computer readable medium drive 308, and an input/output device interface 311, all of which communicate with one another by way of a communication bus. The network interface 304 may provide connectivity to one or more networks or computing systems. The processor(s) 302 may thus receive information and instructions from other computing systems or services via a network, such as network 120.

The processor(s) 302 may also communicate to and from memory 321 and further provide output information or receive input information via the display interface 306 and/or the input/output device interface 311. The input/output device interface 311 may accept input from one or more input devices 324, including, but not limited to, keyboards, mice, trackballs, trackpads, joysticks, input tablets, trackpoints, touch screens, remote controls, game controllers, microcontrollers, microprocessors, circuit boards, velocity sensors, voltage or current sensors, flow sensors, toggle sensors, motion detectors, or any other input device capable of obtaining a position or magnitude value from a user. The input can be received via one or more input ports, including, but not limited to, Bluetooth or other wireless links, optical ports, USB ports, and/or the like. The input/output device interface 311 may also provide output via one or more output devices 322, including, but not limited to, one or more speakers or any of a variety of digital or analog audio capable output ports, including, but not limited to, headphone jacks, XLR jacks, stereo jacks, Bluetooth links, RCA jacks, optical ports or USB ports, as described above. The display interface 306 may be associated with any number of visual or tactile interfaces incorporating any of a number of active or passive display technologies (e.g., electronic-ink, LCD, LED or OLED, CRT, 3D, DLP projection, etc.) or technologies for the display of Braille or other tactile information.

The memory 321 contains computer program instructions that the processor(s) 302 execute in order to implement one or more embodiments of the present disclosure. The memory 321 generally includes RAM, ROM and/or other persistent or non-transitory computer-readable media. The memory 321 may store an operating system 314 that provides computer program instructions for use by the processor(s) 302 in the general administration and operation of the processing device 115. The memory 321 may further include other information for implementing aspects of the present disclosure. For example, in one embodiment, the memory 321 includes a user interface module 312 that facilitates generation of user interfaces (such as by providing instructions therefor) for display. For example, a user interface may be displayed via a navigation interface such as a web browser installed on the processing device 115. In some implementations, the user interface module 312 is communicatively coupled to the input/output device interface 311 and can use information received through the input/output device interface 311 to control or send information to the presentation module 316. In addition, memory 321 may include or communicate with an auxiliary content data store 323. Data stored in the content data store 323 may include audio content, image content, textual content, and/or other data.

The processing device 115 may include one or more graphics cards for converting graphics data into a format suitable for presentation on the display 105. The graphics cards 333 may be any graphics processing module sufficient to generate visual content for presentation on one or more display monitors of the display 105. Multiple graphics cards (e.g., two, three, four or more) can be used to improve processing speeds for generating and outputting the visual content for display. The processing device 115 may also include sound cards to facilitate output of audible content to the display 105.

In addition to the user interface module 312, the memory 321 may include a presentation module 316 that may be executed by the processor(s) 302. In one embodiment, the presentation module 316 may be used to implement various aspects of the present disclosure, such as determining visual and/or audible content to output to the display 105, presenting the visual content for display via the display interface 306, etc., as described further below. In some implementations, a redundant or back-up processing device, having the same design and structural components as the processing device 115 described herein, can be provided in case of system operation failure of the primary processing device.

Referring again to FIG. 2, the processing device 115 can transmit visual content generated by the graphics card(s) 333 to the display 105. The visual content can be output to the display 105 over a communication cable or wireless connection. The communication cable can be a digital video cable implemented using a digital video interface standard, such as a Digital Visual Interface (DVI) cable, a DisplayPort cable, or a High-Definition Multimedia Interface (HDMI) cable. The communication cable may also be capable of transmitting audible content (such as an HDMI cable). In some embodiments, the communication cable can be an analog video cable implemented using an analog standard, such as a radio frequency coaxial cable, a composite video cable, an S-video cable, a component video cable or a video graphics array (VGA) cable.

In some implementations, the graphics card(s) can transmit data to a display control module 222 via a communications cable (such as a DVI cable), which can in turn control the presentation or display of visual content on the array of display monitors 205 (e.g., the display 105). The display control module 222 can be connected to the display 105 by a digital communication cable designed to provide high-quality visual content, such as an HDMI cable; however, other communication cables can be used depending on the display implementation technology. The display control module 222 can include one or more controller modules and one or more power supply modules. The display control module 222 can include, for example, electronics and mechanical structures for video or image processing, display control and output, power supply, cooling, backlighting, monitoring, etc. In some implementations, the display control module 222 includes one or more Clarity™ Matrix modules commercially available from Planar Systems, Inc.

The processing device 115 can be communicatively coupled to the network resource 125 over the network 120. In some implementations, the network resource 125 is communicatively coupled to the processing device 115 via an Ethernet cable connection over a local area network and to other computing devices via the Internet. In some embodiments, the processing device 115 generates micro-posts or other messages to transmit to the network resource 125 for output on one or more social media or microblogging websites 145 (such as Twitter®, Facebook®, Myspace®, Foursquare®, Tumblr®, and/or the like) or on a company proprietary website based on information received from the beverage dispensers. The micro-posts or other messages may also be transmitted to one or more servers for storage.

The micro-posts or other messages can be generated based on information received from the beverage dispensers 110. For example, the micro-posts may be textual messages related to milestones or status of the beverage dispensers 110. Information regarding usage or activity of the beverage dispensers (e.g., number of times activated, total number of ounces of beverage product dispensed, etc.) can be automatically generated based on input signals or data received from the beverage dispensers 110. The information generated can be tracked and stored in memory and then micro-posts can be generated based on the stored information. For example, a micro-post or other message can include information related to the first beverage ingredient used in a particular store that day, the number of times a particular beverage ingredient was used in beverages or the total number of ounces of a particular beverage ingredient dispensed over a period of time, a milestone reached for a quantity of "pulls" of a beverage dispenser corresponding to a particular beverage ingredient, and/or the like. The micro-posts may be targeted messages to particular individuals (e.g., customers) or broadcasts to the general public. In some implementations, the messages can be output via electronic mail, text messages, multimedia messages and/or the like. In yet other implementations, the messages can include video and/or audible content.

In some embodiments, micro-posts or other messages are received by the processing device 115 over the network 120 (such as from the network resource 125). In some implementations, the micro-posts or other messages can be received from third parties (such as customers or patrons). For example, micro-posts posted to a company proprietary social media account (such as a Twitter® account) can be received by the processing device for display. Micro-posts or other messages may also be received from news feeds, RSS feeds, or other sources. The micro-posts or other messages may be generated on a mobile device or other computing device and transmitted to the processing unit 115 via a Wi-Fi connection within the facility or establishment. The micro-posts or other messages could also be generated and transmitted remotely and/or with a network connection other than a Wi-Fi connection. In some implementations, the messages may be generated using a mobile or regular web site or an application downloaded to a mobile computing device. The micro-posts received by the processing device 115 from third parties may pass through a filter or screening process to prevent undesired messages from being presented on the display 105. In some implementations, only micro-posts or other messages from approved personnel or third parties, or the operator of the establishment in which the display 105 is located, can be stored and presented for display.

The micro-posts or other messages, whether received or generated by the processing device 115, can be output on the display 105. In some embodiments, the micro-posts or other messages are stored in memory or a content data store (for example, as implemented by a queue data structure) and output to the display 105 when the display 105 is in the idle display state. The micro-posts can be displayed for a predetermined amount of time or until the idle state is interrupted by a menu state or an active state. In other embodiments, the micro-posts are capable of being displayed in a menu display state or an active display state. The micro-posts can be displayed at a designated location on the display 105 or at random or pseudo-random locations on the display 105.

The micro-posts can be displayed for a particular amount of time during the idle display state (such as ten seconds to sixty seconds) or until the idle state is interrupted. In some implementations, the micro-posts are displayed once and then removed from memory. In other implementations, the micro-posts are stored and displayed randomly or in a predetermined sequence.

In some implementations, when a micro-post has been generated by the processing device 115 based on information received from the beverage dispensers 110 and transmitted to the network resource 125 for communication to a website or other communication devices, the network resource 125 can return the generated micro-post back to the processing device 115 for storage and subsequent presentation on the display 105. The micro-post can then be output for display during the idle display state the next time that the display returns to the idle display state, or sometime thereafter.

III. Beverage Wall Embodiment

Figure 4:
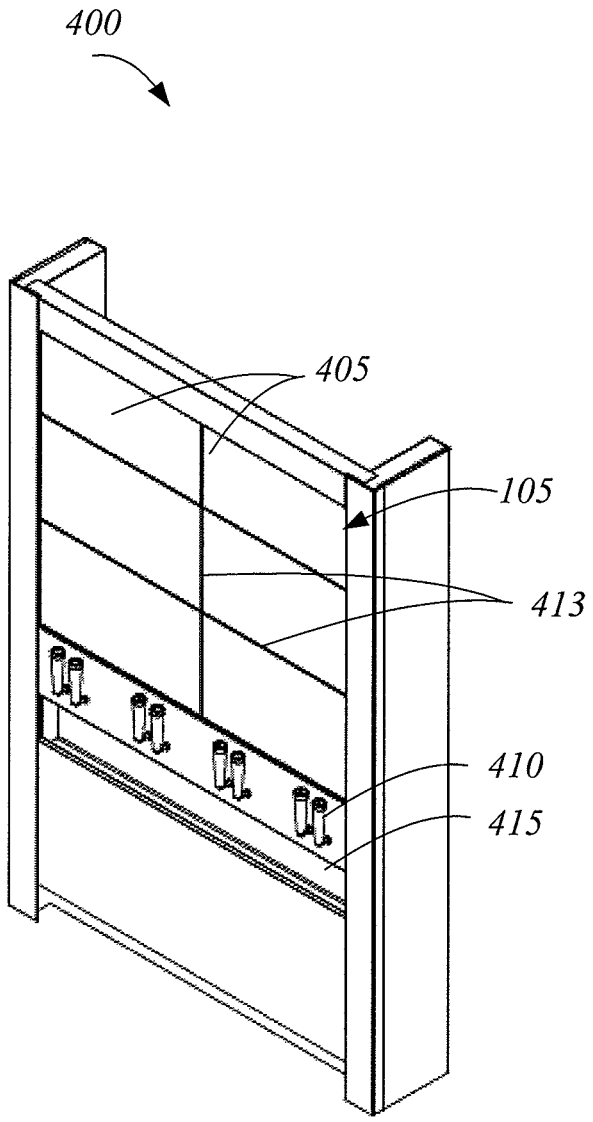
FIG. 4 is a perspective view of an illustrative embodiment of a beverage dispensing and display system.

Turning to FIG. 4, an illustrative embodiment of a beverage wall 400 is depicted, wherein the beverage dispensers 110 and the display 105 can be integrated into a single wall-mounted unit. As shown in FIG. 4, the display 105 can include six display monitors 405 arranged in a 2×3 matrix and the beverage dispensers 110 can include eight beverage taps 410. The beverage taps 410 can be positioned in front of the display 105 so that they can be identified (e.g., labeled) on the display 105, as will be described in more detail below. The beverage taps 410 can be grouped in pairs, with the pairs being spaced apart in an equidistant manner. Two pairs of beverage taps 410 can be positioned and associated with a left half of the display 105 and two pairs of beverage taps 410 can be positioned and associated with a right half of the display 105. In other embodiments, the beverage taps are spaced apart in an equidistant manner without being paired.

As shown in FIG. 4, the beverage taps 410 can include elongated tap handles. The tap handles may be ergonomically shaped for comfort of use and may include features to facilitate gripping by an operator's hand. The tap handles can be designed to be pulled downward and toward an operator user to dispense a beverage product stored within a beverage storage container associated with the particular beverage tap. In accordance with several implementations, each beverage tap 410 dispenses a different beverage ingredient (e.g., juice type, flavor, or ingredient). A cup or other beverage receptacle can be placed within the opening 412 below a beverage tap 410 to receive the beverage product when the beverage tap 410 is pulled.

The bezels or mullions 413 between the display monitors 405 can be minimized to reduce obstruction with the visual content being displayed. For example, the bezels or mullions can be a quarter-inch or less. In some embodiments, the display monitors 405 are black and positioned behind damage-resistant glass. In other embodiments, the display monitors 405 are grey and/or white but may still appear black with white illuminated content. The size, the coloring, the quantity, and/or the shielding of the display monitors, may vary as desired and/or required. For example, the diagonal length of the display monitors can range from thirty-two inches to sixty inches (e.g., thirty-six inches, forty-two inches, forty-six inches, fifty inches, sixty inches); however, other monitor sizes can be used as desired and/or required.

IV. Illustrative Display State Control Routine

Figure 5:
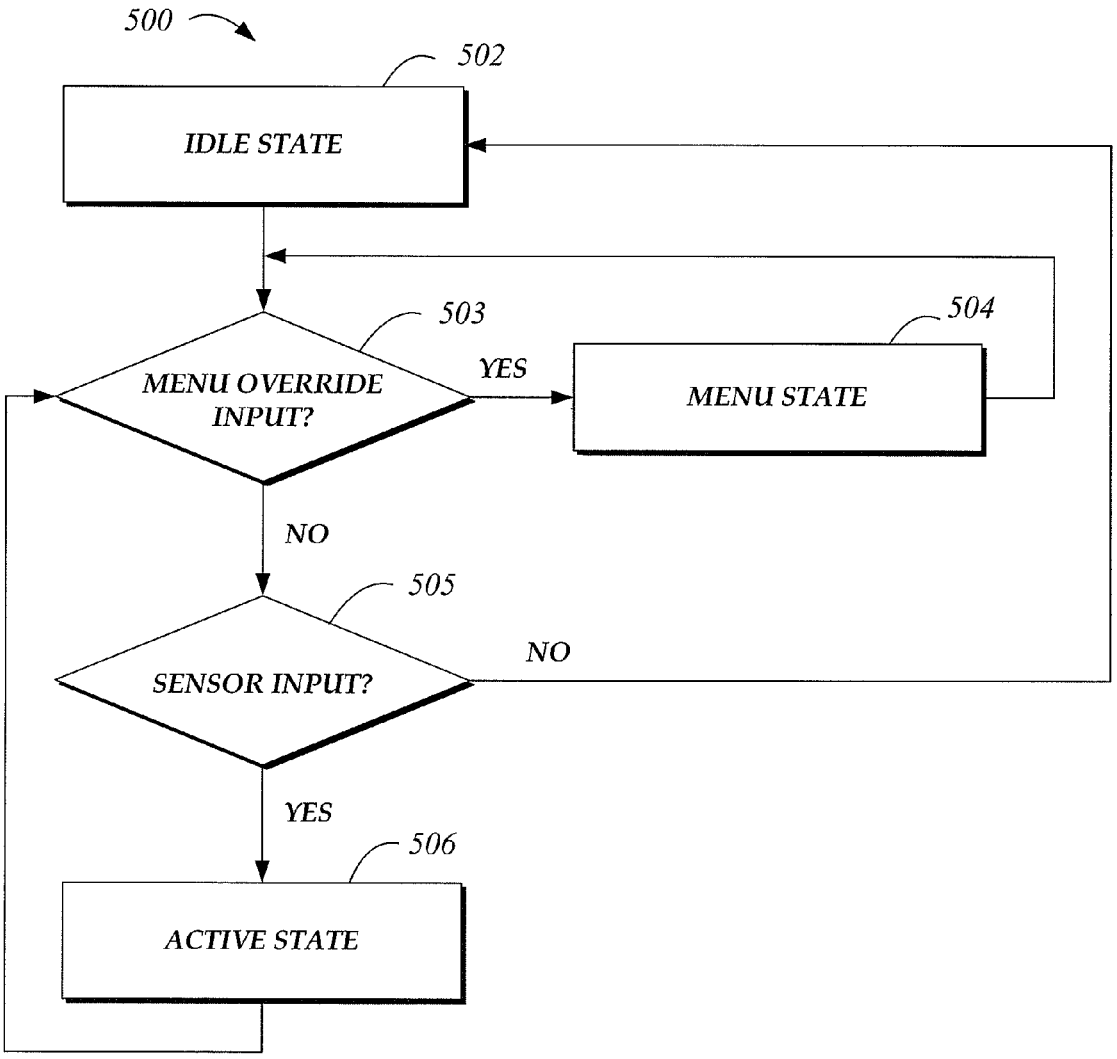
FIG. 5 is a flow diagram of an illustrative display state control routine implemented by the processing device of FIG. 1.

With reference to FIG. 5, the processing device 115 can cause the display 105 to transition between multiple display states. FIG. 5 is a flow diagram of an illustrative display state control routine 500 that can be implemented by the processing device 115. As one illustrative example, the display states can include an idle state, an active state, and a menu state. Different categories and types of visual content can be associated with and displayed for each display state, as described in more detail herein. The display state control routine 500 can be executed by the processing device 115 to determine when to transition between display states.

The illustrative display state control routine 500 begins at block 502 with the display in an idle display state. The idle display state can be a default state in which no inputs are being received by the processing device 115. For example, the idle display state can correspond to situations when no beverage products are currently being dispensed or have not been for a period of time. In the idle state, the visual content displayed on the display 105 can include content related to brand statements, process statements, health promotion program statements, nutrition statements, ingredient information (such as historical or fun facts), product information (such as hand-crafted or custom beverage products), or information based on use or status of the beverage dispensers (such as the first beverage made for the day or the first beverage ingredient for the day, milestone information regarding particular beverage ingredients (such as "Pineapple was pulled for the $100^{th}$ time")), weather information, local event information, promotional information, advertising information, information received from one or more social media websites (e.g., micro-posts) and/or other types of information.

In some implementations, the visual content is provided as a series of animations (e.g., as .mov, .avi, .divx, .mp3, .mpeg or other video file formats). The animations can be displayed randomly or pseudo-randomly (for, example, the animations can have parameters set to control frequency). In some implementations, the animations can be displayed according to a pre-determined sequence that continuously loops.

While in the idle display state, the processing device 115 can continuously monitor its input ports to determine whether any input signals have been received. At decision block 503, the processing device 115 determines whether a menu override input has been received. If a menu override input signal has been received, the processing device 115 can cause the display 105 to enter into a menu display state at block 504.

The menu override input signal can be transmitted to the processing device 115 upon activation of an operator input, such as a button, switch, touchscreen, or the like. The operator input can be any input capable of having an on state and an off state. In some implementations, the menu override input signal is received from the input control module 130. The menu display state can take precedence over the active and idle states, such that the current visual content being displayed is replaced with content corresponding to the menu display state. In the menu display state, a digital menu can be presented on the display 105. The digital menu can be static or dynamic and can include graphical (e.g., visual representations of beverage ingredients) and/or alphanumeric information (e.g., textual identifiers or descriptions of beverage ingredients and/or pricing information). The digital menu can be presented on substantially the entire display 105 or on one or more portions of the display. In some implementations, content other than menu content can also be displayed (for example, nutritional information or any of the other information described above with respect to the idle display state).

The digital menu content can be stored in memory 321 of the processing device 115 or on the content data store 323 and can be updated (e.g., via an input device 324) as the beverage products, ingredients, or flavors being dispensed by the beverage dispensers 110 are changed. The processing device 115 can cause the display 105 to remain in the menu display state until the menu override input signal is no longer being received (for example, when the menu override input is in the off, or inactive, state). In some implementations, the display 105 remains in the menu display state until an input is received by the processing device 115 from the beverage dispensers 110. In other implementations, the display 105 remains in the menu display state until a predetermined period of time has elapsed.

If, at decision block 503, a menu override input signal is not received by the processing device 115, the processing device 115 determines whether any sensor input signals are being received from one or more of the beverage dispensers 110 corresponding to beverage products being dispensed (block 505). If no sensor input signals are being received by the processing device 115 and have not been received for a predetermined amount of time (for example, a time period between ten seconds to sixty seconds), then the processing device 115 causes the display to return to the idle display state (block 502). If, however, sensor input signals are being received by the processing device 115 or have been received within the predetermined amount of time, then the processing device 115 causes the display 105 to enter into an active display state at block 506.

The processing device 115 may cause the display 105 to remain in the active display state as long as input signals are being received corresponding to the beverage dispensers 110 and as long as no menu override input signals are received (e.g., from the input control module 130). Accordingly, once the processing device 115 causes the display 105 to enter the active display state, the routine 500 may return to decision block 503. While in the active display state, the processing device 115 may cause dynamic visual content to be presented on the display 105 that is related to beverage ingredients being dispensed by the beverage dispensers 110, as will be described in more detail below. As one example, when a tap handle of a beverage dispenser is pulled, visual swirls corresponding to the beverage ingredient being dispensed by the beverage dispenser can appear and follow an animation sequence for a period of time. The visual swirls can then resolve to an image representing the beverage ingredient. According to several embodiments, the active display state is more dynamic than the idle display state and the menu display state, and can present a "living" display experience to viewers.

V. Illustrative Dynamic Graphical Display Content

Turning to FIGS. 6A-6D, a series of illustrative screen shots of a display 105 are depicted that show a presentation of dynamic visual content while beverage ingredients are being dispensed by beverage dispensers 110 (e.g., when the display 105 is in the active display state). The visual content depicted in FIGS. 6A-6D is merely illustrative of one example of how the dynamic visual content can be implemented. Other visual content or animation sequences can be used as desired without departing from the spirit and/or scope of the disclosure.

As shown in FIGS. 6A-6D, the processing device 115 can cause labels 665 to be presented on the display 605 for each of the taps 610 of the beverage dispensers. For example, the labels 665 can be positioned above their respective taps 610. In some implementations, the handles of the taps 610 are entirely below the display 605 (as is schematically depicted in FIGS. 6A-6D). In other implementations, an upper portion of the handles of the taps 610 overlaps and is slightly above and in front of the lower boundary of the display 605.

In some implementations, the labels 665 include an image and a title of the beverage ingredient (e.g., a mandala) associated with each beverage dispenser. Other implementations can be used as desired (for example, text only or graphical images only). The labels 665 may be constantly displayed while the display is in the active display state and/or in the idle display state. In some implementations, the labels 665 are also displayed in the menu display state. By way of example, the beverage ingredients depicted in FIGS. 6A-6D include carrot juice, pineapple juice, greens juice, beet juice, coconut juice, apple juice, cucumber juice, and seasonal tea; however, other beverage ingredients can be used as desired without departing from the spirit and/or scope of the present disclosure. The labels 665 can be changed (e.g., updated) as beverage ingredients associated with the beverage taps 610 change (for example, based on input received by the processing device 115).

Figure 6A:
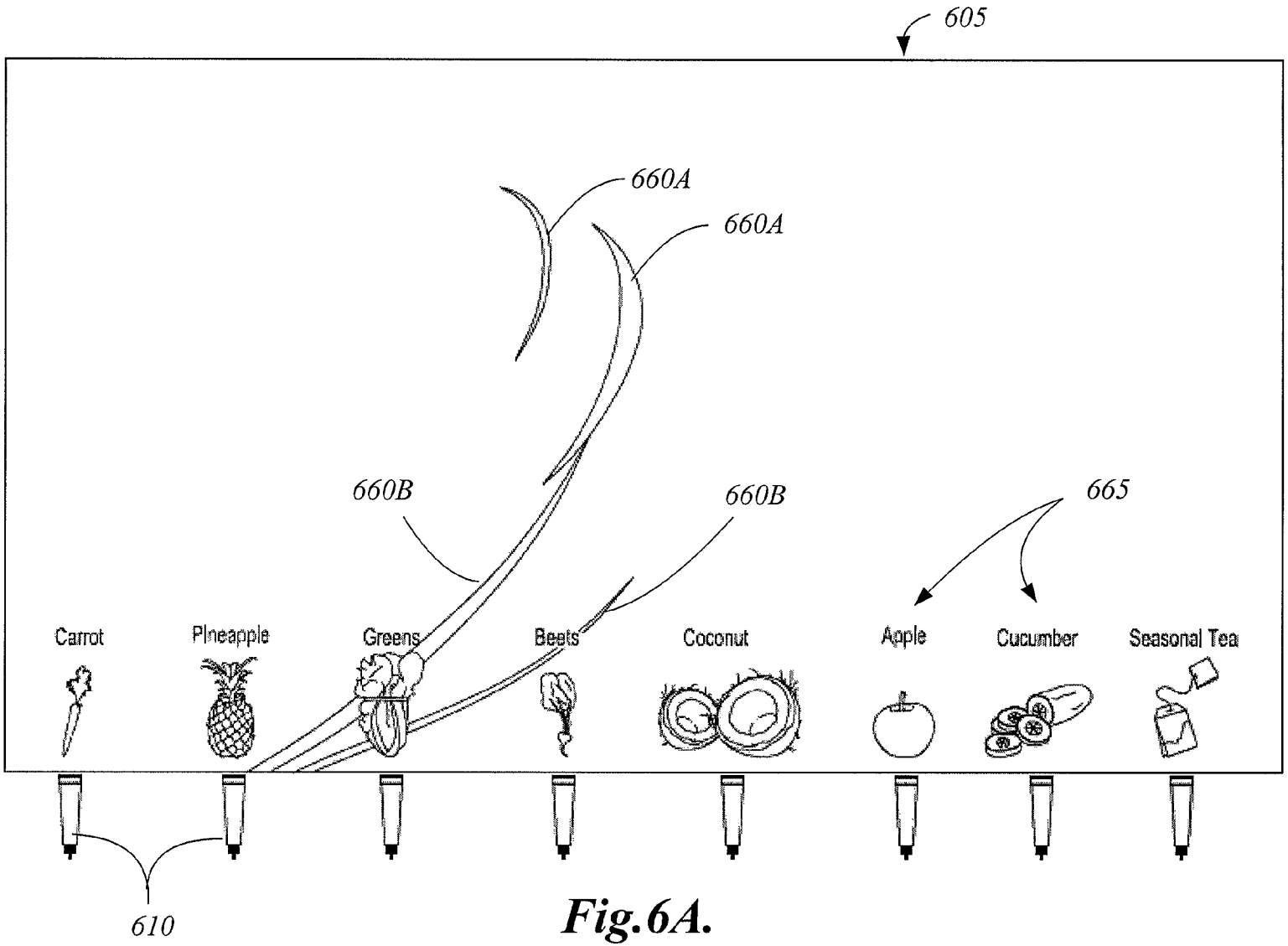
FIGS. 6A-6D depict illustrative visual content which can be dynamically presented on a display of the beverage dispensing and display system of FIG. 1.

FIG. 6A illustrates the display 105 after the beverage dispensers for carrot juice and pineapple juice have been activated (e.g., pulled). Upon activation of a beverage dispenser (e.g., by pulling down on a tap handle), a visual representation of the beverage ingredient being dispensed by the beverage dispenser can be presented on a display 605. The visual representation can originate at a location adjacent to the beverage dispenser that is dispensing a beverage ingredient, thereby providing an indication that the visual representation corresponds to a particular beverage ingredient. For example, in some implementations, the visual representation originates at a predetermined pixel coordinated position corresponding to a physical position of the beverage dispenser. In some implementations, the visual representation includes one or more animated swirl elements 660 that grow from the originating location and evolve to a circle surrounding a center point of the display 605. The swirl elements can represent peels (e.g., fruit peels) of the beverage ingredients in some implementations. As shown in FIG. 6A, the two swirl elements 660B corresponding to pineapple juice are originating from positions generally above the beverage tap 610 that is dispensing pineapple juice. While FIGS. 6A-6D describe swirl elements 660 as the visual representations, other graphical imagery can be used without departing from the spirit and/or scope of the disclosure. For example, circles, columns, pillars, lines, or other shapes or images can be used.

The number of swirl elements 660 generated for each beverage ingredient and/or the length of the swirl elements 660 can depend on the duration of time that the beverage dispenser is activated (e.g., how long the beverage dispenser is pulled), thereby providing a visual indication of the quantity of the beverage ingredient dispensed. As shown in FIG. 6A, activation of the beverage dispensers for the carrot juice and the pineapple juice generated two swirl elements 660A, 660B for each respective beverage ingredient. The physical characteristics and properties of the swirl elements (or other visual representation) can vary. For example, the swirl elements 660 for each beverage ingredient can have a different color and/or texture. In some implementations, the color and the texture are based on the beverage ingredient that they represent. The visual characteristics and properties of the swirl elements 660 may also include length, thickness, velocity, pattern, direction of circle path, and/or radius size of the circle formed by the swirl elements (which may be predetermined for each beverage product or may vary from swirl element to swirl element). At least some of the physical characteristics and properties can be set to random, pseudo-random or fractal values. For example, dimensional values of the swirl elements 660 can be selected randomly from a predetermined range of values.

Figure 6B:
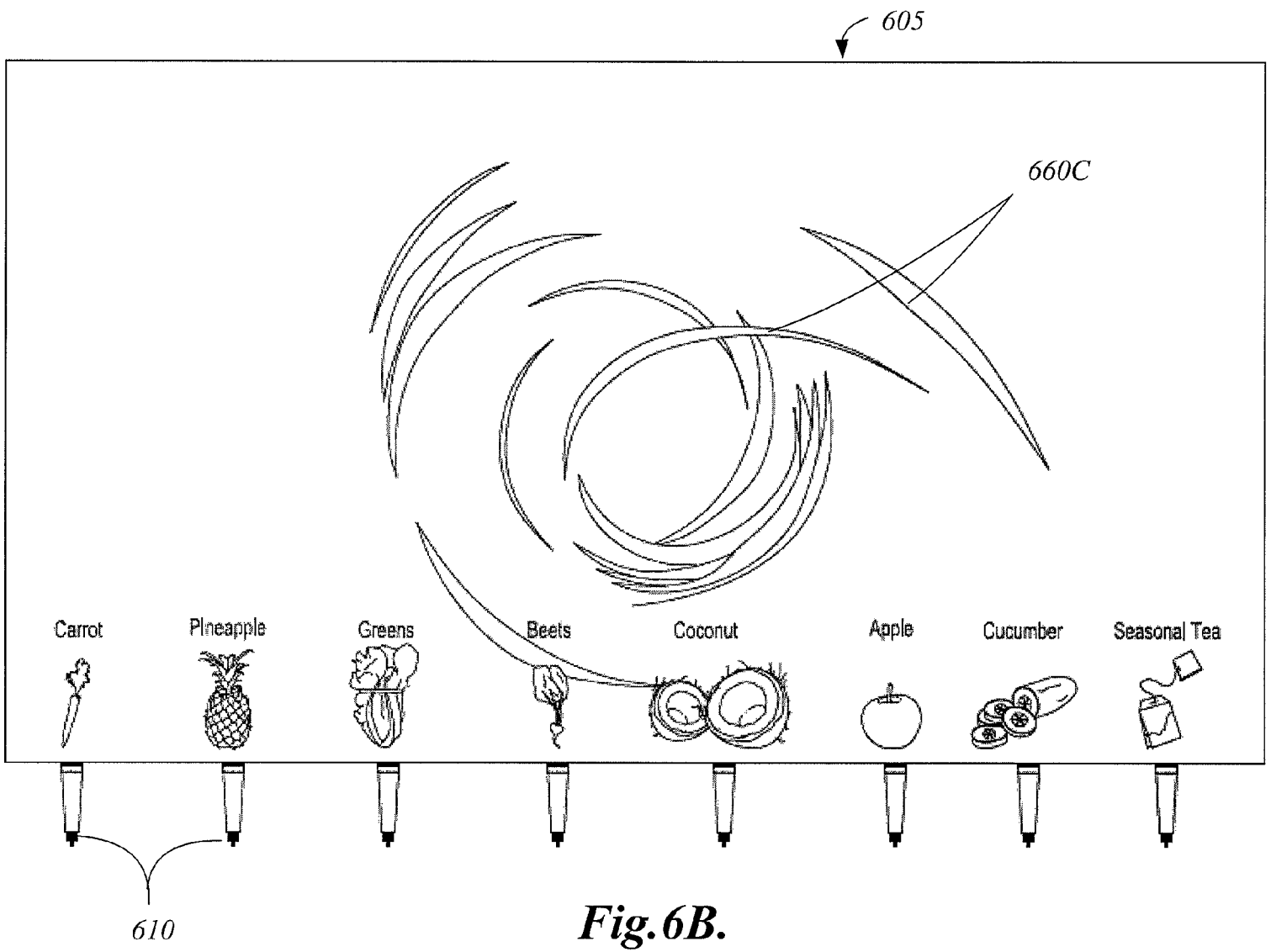
Figure 6C:
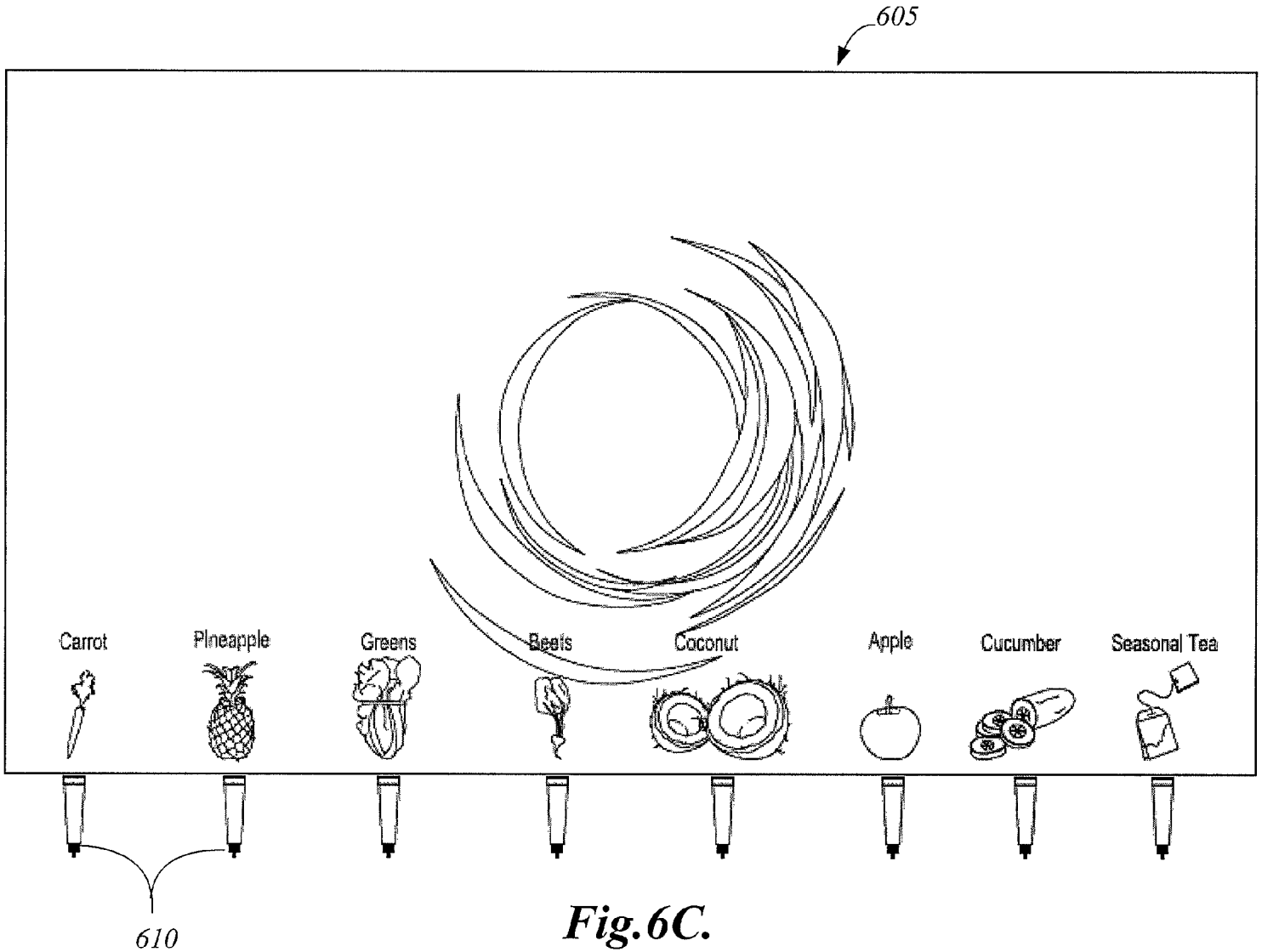
Figure 6D:
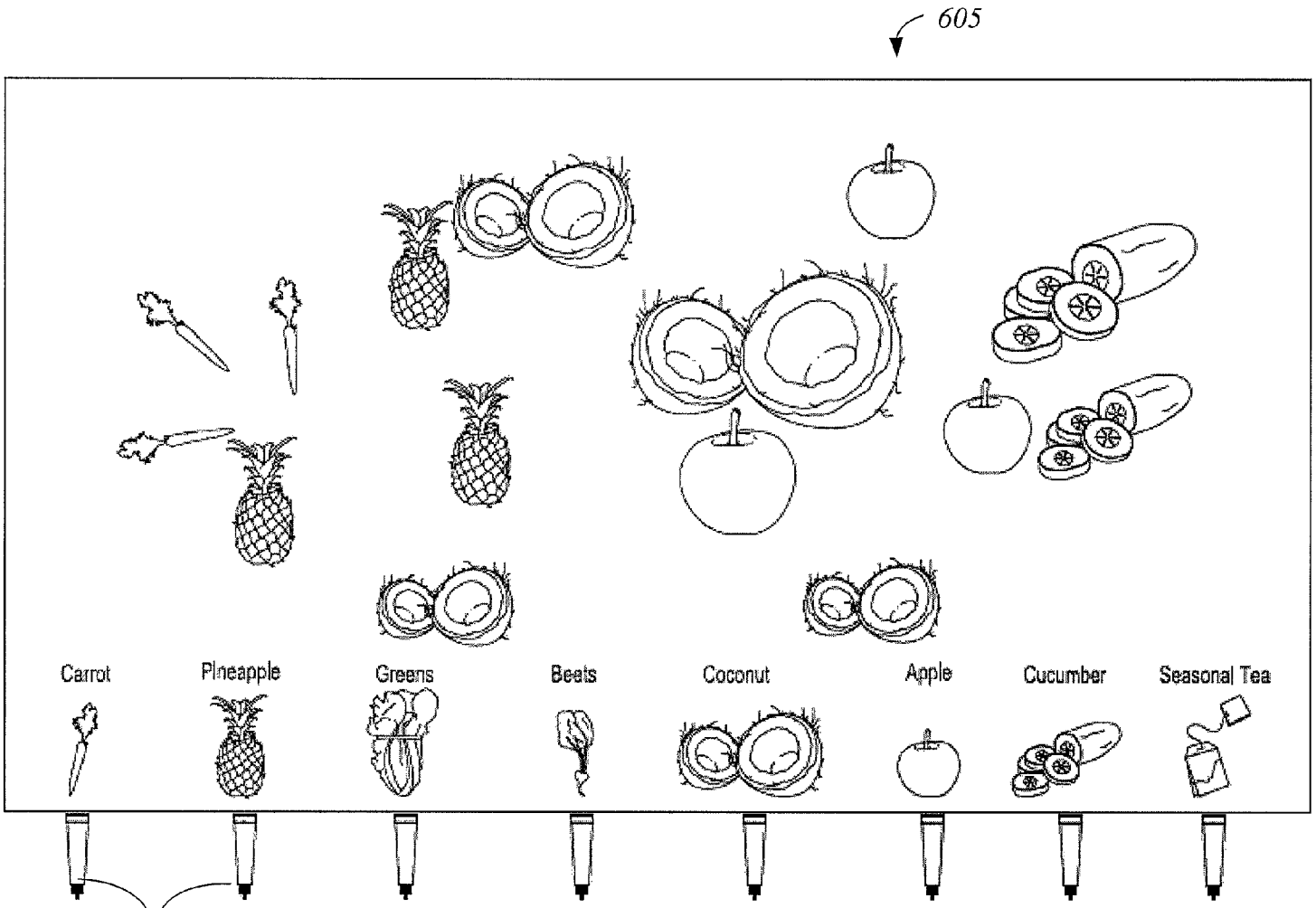

Turning to FIG. 6B, the visual content presented on the display 605 corresponds to a situation in which six different beverage dispensers 110 (corresponding to six different beverage ingredients) have been activated within a short period of time, with the swirl elements 660C corresponding to the seasonal tea having been generated most recently. The various swirl elements 660 corresponding to the different beverage ingredients are represented in a swirling, generally circular motion. The swirl elements 660 corresponding to the different beverage ingredients may blend and/or overlap with each other. In some implementations, the opacity values of each swirl element change when swirl elements overlap, such that the swirl elements blend together (not shown). The colors and/or textures of the swirl elements may change. For example, two overlapping swirl elements (including the edges of the swirl elements) can blend together to form a single swirl element. In some implementations, the swirl elements or other visual representations Turning to FIG. 6C, the various swirl elements 660 have generally completed their traversal to their final generally circular path of motion around a central point of the display 605. With reference to FIG. 6D, the swirl elements 660 have resolved to images of their respective beverage ingredients. As shown, the images of each beverage ingredient may be presented in a position within a general region of the label 665 and beverage tap 610 corresponding to the respective beverage ingredient. However, in other implementations, the images can be presented randomly at various positions on the display 605. Also as shown in FIG. 6D, multiple instances of the images of the beverage ingredients can be presented. The number of images can correspond to the number of swirl elements 660, can be random, or can be the same for each beverage ingredient.

VI. Illustrative Beverage Tap Sensor Implementation

Figure 7:
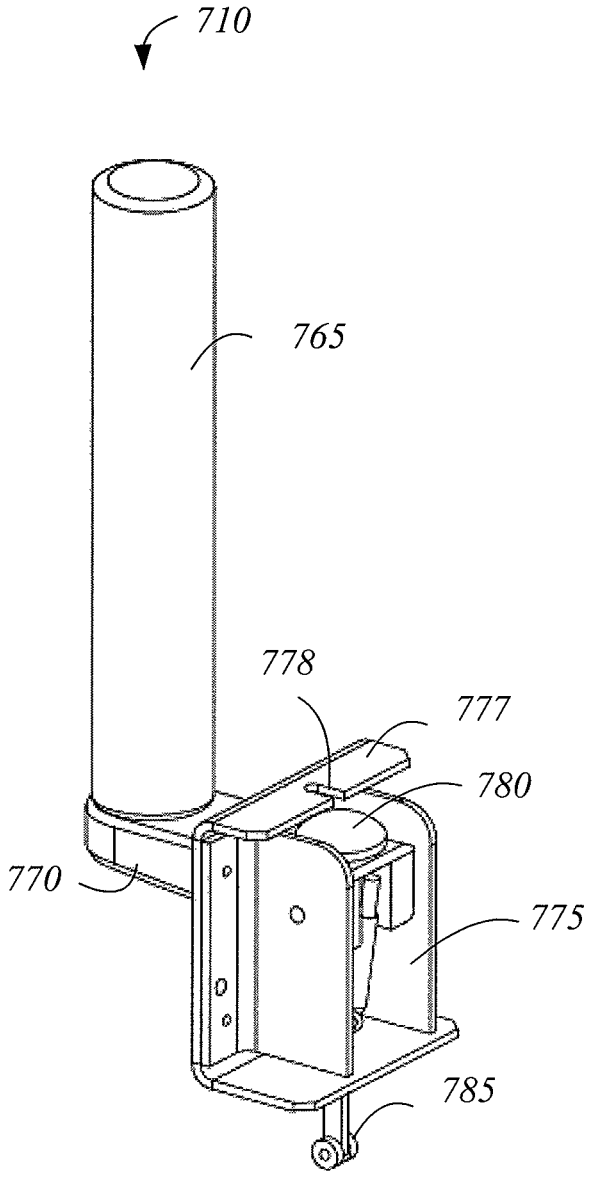
FIG. 7 is a perspective view of an illustrative embodiment of a beverage tap that includes a sensor for sending information to the processing device regarding operation of the beverage tap.

With reference to FIG. 7, an illustrative embodiment of a beverage tap 710 capable of transmitting signals (e.g., data) to the processing device 115 for use in determining the visual content to output for display, when to output the visual content, and how to dynamically modify the visual content is depicted. The beverage tap 710 includes an elongated pull handle 765, a lever arm 770, a housing 775, a contact plate 777, a sensor 780, and an activation member 785.

The elongated pull handle 765 is mounted to a proximal end of the lever arm 770, which may be suspended by one or more articulating support members (not shown) designed to facilitate operation of the beverage tap 710. In some implementations, the sensor 780 is coupled (e.g., mounted) to a distal end of the lever arm 770. As the pull handle 765 is pulled downward by an operator, the proximal end of the lever arm 770 lowers and the distal end of the lever arm 770 raises, thereby causing the sensor 780 to be activated upon contact with the contact plate 777. As shown in FIG. 7, the sensor 780 can be a push-button sensor designed to be toggled on and off by pressing and depressing a button member.

In other implementations, the sensor 780 can be coupled to the contact plate 777 (such as the undersurface of the contact plate 777) in a manner such that the button member is facing toward the distal end of the lever arm 770 (e.g., upside-down compared to the orientation of the sensor 780 as depicted in FIG. 7). In some implementations, the sensor 780 can be coupled to the contact plate 777 by inserting a portion of the sensor 780 within a slot 778 of the contact plate 777. The distance between the contact plate 777 and the distal end of the lever arm 770 can be dimensioned based on the size dimensions of the sensor 780.

The activation member 785 can be designed to engage or otherwise contact a structural member that effects dispensing of a beverage product. In some implementations, as the pull handle 765 is pulled downward by an operator, the activation member 785 can be caused to move downward by intermediate articulating members, which in turn causes the activation member 785 to engage a structural member that causes beverage product to be dispensed (either directly or indirectly through other structural members). In some implementations, the activation member 785 does not physically effect dispensing of the beverage product but instead transmits a signal to effect dispensing of the beverage product. In some implementations the functions of the sensor 780 and the activation member 785 can be combined into a single structural element.

Although the sensor 780 is depicted as a push-button sensor that is toggled on and off by pressing and depressing a button member, other types of sensors can be used as desired without varying the spirit and/or scope of the disclosure. For example, in some implementations, the sensor can be implemented as a switch formed by two conductive plates that complete a circuit when in contact but when broken by movement of one of the plates away from the other, causes a break in the circuit. In yet other implementations, the sensor can be a flow sensor positioned in a location that detects flow of beverage product out of the beverage dispenser. In still other implementations, the sensor can be a motion sensor, a proximity sensor, a touch sensor, a microsensor, an acoustic sensor, a vibration sensor, an accelerometer, a chemical sensor, an electric current sensor, a pressure sensor, a contact sensor, a photoelectric sensor, a fiber optic sensor, a light sensor, an infrared sensor, an electro-optical sensor or any other type of sensor or switch. The sensor 780 can be a single sensor or multiple sensors.

As described above, the sensor 780 can transmit information (e.g., signals, data) to the input control module 130 or directly to the processing device 115 and the processing device 115 can generate and present dynamic visual content based, at least in part, on the information received from the sensor 780. In yet other embodiments, the sensor information may be transmitted to a remote or off-site computing device or server for generation of the dynamic visual content and/or other processing.

VII. Terminology

As used herein, the term "beverage," in addition to having its ordinary meaning, can include, among other things, any liquid substance or product having a flowing quality such as juices, coffee beverages, teas, frozen yogurt, beer, wine, cocktails, liqueurs, spirits, cider, soft drinks, flavored water, energy drinks, combinations of the same, or the like. Further, although this specification refers primarily to dynamic graphical displays associated with beverage dispensing systems, the systems, methods and techniques described herein can also be applied to other types of dispensing systems, including but not limited to food dispensing systems, edible substance dispensing systems, or merchandise dispensing systems. As used herein, the terms "beverage product" and "beverage ingredient," in addition to having their ordinary meanings, can be used interchangeably and can include among other things, beverage types, flavors, ingredients, products, combinations of the same, or the like.

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

All of the processes described herein may be embodied in, and fully automated via, software code modules executed by one or more general purpose or specialized computers or processors. The code modules may be stored in any type of computer-readable medium or other computer storage device. Some or all the methods may alternatively be embodied in specialized computer hardware. In addition, the components referred to herein may be implemented in hardware, software, firmware or a combination thereof. A software module can reside in RAM memory, flash memory, ROM memory, EPROM memory, EEPROM memory, registers, hard disk, a removable disk, a CD-ROM, or any other form of non-transitory computer-readable storage medium known in the art. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth.

Conjunctive language such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require at least one of X, at least one of Y and at least one of Z to each be present. Also, the term "or" is used in its inclusive sense (and not in its exclusive sense) so that when used, for example, to connect a list of elements, the term "or" means one, some, or all of the elements in the list.

Any process descriptions, elements or blocks in the flow diagrams described herein and/or depicted in the attached figures should be understood as potentially representing modules, segments, or portions of code which include one or more executable instructions for implementing specific logical functions or elements in the process. Alternate implementations are included within the scope of the embodiments described herein in which elements or functions may be deleted, executed out of order from that shown, or discussed, including substantially concurrently or in reverse order, depending on the functionality involved as would be understood by those skilled in the art. Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together. Execution in a cloud computing environment in some embodiments supports a multiplicity of conditions to be computed contemporaneously.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration. A computing environment can include any type of computer system, including, but not limited to, a computer system based on a microprocessor, a mainframe computer, a digital signal processor, a portable computing device, a personal organizer, a device controller, and a computational engine within an appliance, to name a few.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. A system for presenting dynamic visual content corresponding to the dispensing of beverages on a display, the system comprising:

a display comprising a plurality of individual wall-mounted monitors arranged in a matrix pattern to form an integrated unit;

a plurality of beverage dispensers positioned below the display, each beverage dispenser configured to dispense a particular beverage ingredient, wherein at least one beverage dispenser of the plurality of beverage dispensers comprises a tap including:

a pull handle; and a sensor actuatable in response to movement of the pull handle to a beverage dispensing position that effects active dispensing of the particular beverage ingredient by the at least one beverage dispenser, wherein the sensor, when actuated in response to the movement of the pull handle, generates a signal indicative of an operational state of the at least one beverage dispenser;

a microcontroller in communication with the sensor, the microcontroller configured to receive the signal indicative of the operational state of the at least one beverage dispenser and to generate an output indicative of the operational state of the at least one beverage dispenser; and a processing device in communication with the microcontroller and the display, the processing device configured to:

determine that the at least one beverage dispenser is actively dispensing a particular beverage ingredient based at least partly on information received from the microcontroller indicative of the operational state of the at least one beverage dispenser of the plurality of beverage dispensers; and in response to determining that the at least one beverage dispenser is actively dispensing the particular beverage ingredient, cause output, on the display, of dynamic visual content representing the particular beverage ingredient being dispensed by the at least one beverage dispenser of the plurality of beverage dispensers.

2. The system of claim 1, wherein the plurality of individual wall-mounted monitors comprises at least four individual wall-mounted monitors arranged in the matrix pattern.

3. The system of claim 1, wherein the system further comprises a data store in communication with the processing device, the data store configured to store information regarding beverage ingredients to be dispensed by the beverage dispensers.

4. The system of claim 1, wherein the processing device is further configured to generate audible content.

5. The system of claim 1, wherein the dynamic visual content comprises a visual representation of the particular beverage ingredient being actively dispensed by the at least one beverage dispenser.

6. The system of claim 1, wherein the dynamic visual content represents at least one physical characteristic of the particular beverage ingredient being actively dispensed.

7. The system of claim 1, wherein the plurality of beverage dispensers comprises eight beverage dispensers.

8. The system of claim 1, further comprising a menu override input device in communication with the microcontroller, wherein the menu override input device, when actuated, generates an override input signal, the microcontroller is further configured to receive the override input signal from the menu override input device and provide information indicative of the override input signal to the processing device, and in response to receiving the information indicative of the override input signal, the processing device is further configured to cause output on the display, of menu content in lieu of the dynamic visual content.

9. The system of claim 1, wherein the dynamic visual content resolves into an image of the particular beverage ingredient being actively dispensed after a period of time following initiation of active dispensing of the particular beverage ingredient by the at least one beverage dispenser in response to movement of the pull handle to a beverage dispensing position.

10. The system of claim 1, wherein the processing device is further configured to cause output, on the display adjacent to the at least one beverage dispenser, of a label corresponding to the particular beverage ingredient to be dispensed by the at least one beverage dispenser.

11. The system of claim 5, wherein the visual representation portrays a color and a texture corresponding to the particular beverage ingredient being actively dispensed.

12. The system of claim 1, wherein the dynamic visual content comprises animated digital content.

13. A system comprising:

a display;

a plurality of product dispensers associated with the display, each product dispenser configured to dispense a particular product, wherein at least one product dispenser of the plurality of product dispensers comprises a tap including:

a handle; and a sensor actuatable in response to movement of the handle to a product dispensing position that effects active dispensing of the particular product by the at least one product dispenser, wherein the sensor, when actuated in response to the movement of the handle, generates a signal indicative of an operational state of the at least one product dispenser; and a processing device in communication with the display, the processing device configured to:

determine that the at least one product dispenser is actively dispensing a particular product based at least partly on the signal indicative of the operational state of the at least one product dispenser;

determine the particular product being actively dispensed by the at least one product dispenser; and in response to determining the particular product being actively dispensed, cause output, on the display, of dynamic visual content representing the particular product being actively dispensed by the at least one product dispenser of the plurality of product dispensers.

14. The system of claim 13, further comprising a menu override input device in communication with the processing device, wherein the menu override input device, when actuated, generates an override input signal and provides information indicative of the override input signal to the processing device, and in response to receiving the information indicative of the override input signal, the processing device is further configured to cause output on the display of menu content in lieu of the dynamic visual content.

15. The system of claim 13, wherein the display comprises an array of multiple individual wall-mounted monitors arranged together in a matrix pattern to form an integrated display unit.

16. The system of claim 13, wherein the dynamic visual content comprises animated digital content.

17. The system of claim 13, wherein the tap further comprises an activation member.

18. The system of claim 13, wherein the particular product comprises a food or beverage.

19. The system of claim 18, wherein the particular product comprises at least one of a: juice, coffee beverage, tea, frozen yogurt, beer, wine, cocktail, liqueur, spirit, cider, soft drink, flavored water, and energy drink.

* * * * *